US008699202B2

(12) United States Patent
Ohshima

(10) Patent No.: US 8,699,202 B2
(45) Date of Patent: Apr. 15, 2014

(54) HEAT GENERATION INHIBITING CIRCUIT FOR EXCITING COIL IN RELAY

(75) Inventor: Shunzou Ohshima, Kosai (JP)

(73) Assignee: Yazaki Corporation, Tokyo (JP)

( * ) Notice: Subject to any disclaimer, the term of this patent is extended or adjusted under 35 U.S.C. 154(b) by 14 days.

(21) Appl. No.: 13/394,412

(22) PCT Filed: Dec. 21, 2010

(86) PCT No.: PCT/JP2010/073043
§ 371 (c)(1),
(2), (4) Date: Mar. 6, 2012

(87) PCT Pub. No.: WO2011/078187
PCT Pub. Date: Jun. 30, 2011

(65) Prior Publication Data
US 2012/0162846 A1 Jun. 28, 2012

(30) Foreign Application Priority Data
Dec. 21, 2009 (JP) ..... 2009-289678

(51) Int. Cl.
*H01H 47/00* (2006.01)

(52) U.S. Cl.
USPC ..... 361/189

(58) Field of Classification Search
USPC ..... 361/189
See application file for complete search history.

(56) References Cited

U.S. PATENT DOCUMENTS

| | | | | |
|---|---|---|---|---|
| 3,527,891 | A * | 9/1970 | Johnston | 340/2.71 |
| 3,789,232 | A * | 1/1974 | Wareing | 340/458 |
| 4,683,403 | A * | 7/1987 | Iwamoto et al. | 315/83 |
| 5,142,428 | A * | 8/1992 | Takeda | 361/42 |

FOREIGN PATENT DOCUMENTS

| | | |
|---|---|---|
| JP | 39-15330 | 6/1964 |
| JP | 53-74041 | 6/1978 |
| JP | 2002-170466 A | 6/2002 |

OTHER PUBLICATIONS

International Search Report (PCT/ISA/210) dated Feb. 15, 2011, issued in International Application No. PCT/JP2010/073043.
Written Opinion (PCT/ISA/237) dated Feb. 15, 2011, issued in International Application No. PCT/JP2010/073043.

* cited by examiner

*Primary Examiner* — Scott Bauer
(74) *Attorney, Agent, or Firm* — Sughrue Mion, PLLC

(57) ABSTRACT

A resistor is provided between an exciting coil and the ground, and a diode is provided between a point p1 and a point p2. An exciting current flows on the ground side via the diode until a relay contact is closed immediately after a switch is turned on. Thus, a voltage applied to the exciting coil becomes almost same as a power supply voltage, the relay contact can be surely closed. Further, when the relay contact is closed, since the exciting current flows on the ground side via the resistor the voltage applied to the exiting coil reduces and hence the heat generation amount can be reduced.

10 Claims, 3 Drawing Sheets

HEAT GENERATION INHIBITING CIRCUIT FOR EXCITING COIL IN RELAY

TECHNICAL FIELD

The present invention relates to a heat generation inhibiting circuit for inhibiting the heat generation of an exciting coil provided in a relay circuit.

BACKGROUND ART

For example, a relay circuit for controlling the driving and stop of various kinds of loads such as a lamp and a motor mounted on a vehicle is used in a state of being mounted on a PCB substrate. In such the relay circuit, power loss is generated when an exciting coil for exciting a relay contact is supplied with current. The power loss is converted into heat energy to increase the temperature of the PCB substrate. In the case of using the PCB substrate within an engine room of a high ambient temperature, since such the use causes the temperature of various devices mounted on the PCB substrate to exceed the allowable temperature thereof, it becomes difficult to mount may relay circuits on the PCB substrate. In other words, since the number of the relay circuits capable of being mounted on the PCB substrate is restricted, the size of the PCB substrate becomes large.

Hereinafter, the principle of the heat generation of the exciting coil of the relay circuit will be explained with reference to FIGS. 6 and 7. As shown in FIG. 6, a relay circuit RLY is provided between a DC power supply VB (for example, a battery mounted on a vehicle, hereinafter abbreviated as VB) and a load RL, and the relay circuit RLY includes a normally-opened relay contact Xa and an exciting coil Xc. When a switch SW1 provided between the exciting coil Xc and the power supply VB is turned on, the exciting coil Xc is applied with the power supply voltage VB (the output voltage of the power supply VB is shown by the same symbol VB) and so the exciting coil Xc is energized. Thus, since the normally-opened relay contact Xa is closed, a load circuit is supplied with current to drive the load RL.

Further, as shown in FIG. 7, in the case of providing the witch SW1 between the exciting coil Xc and the ground, when the switch SW1 is turned on, the load circuit is also supplied with current to drive the load RL.

Supposing that the resistance value of the exciting coil Xc is Ra, the power loss (heat generation amount) of the exciting coil Xc can be represented as $VB^2/Ra$. In order to reduce the heat generation amount, it is necessary to increase the resistance value Ra of the exciting coil Xc. However, when the resistance value Ra is merely increased, since the magnetic flux generated in the exciting coil Xc reduces, the minimum operation voltage for closing the relay contact Xa increases. Thus, there is a limit in the method of reducing the heat generation amount of the exciting coil Xc by increasing the resistance value Ra. In this manner, it is required both to sufficiently secure the minimum operation voltage of the exciting coil Xc and to reduce the heat generation amount.

In order to solve such the problem, there is known the technique disclosed in JP-A-2002-170466 (patent document 1). FIG. 8 is a circuit diagram showing the configuration of a relay driving circuit described in the patent document 1. In this figure, when an NPN type transistor 101 is turned on, since a PNP type transistor 102 is turned on to by-pass a resistor R101, an exciting coil Xc is applied with the output voltage of the power supply VB. Thus, a relay contact Xa is closed to thereby turn the transistor 102 off, whereby since the voltage applied to the exciting coil Xc reduces, the heat generation amount of the exciting coil Xc can be reduced.

PRIOR ART DOCUMENT

Patent Document

Patent Document 1: JP-A-2002-170466

SUMMARY OF THE INVENTION

Problems that the Invention is to Solve

However, in the related art disclosed in the patent document 1, a leak current flows from the exciting coil Xc to a load RL via the transistor 102 and a resistor 102 during the turning-off of the transistor 102, that is, during the stop of the load RL. Thus, when this technique is applied to a load circuit mounted on a vehicle, when the power supply voltage VB is high, the relay contact Xa is closed even if the transistor 101 is turned off. Thus, since this fact causes the run-out of a battery of a parked vehicle, this technique is not practical disadvantageously.

This invention is made in order to solve the aforesaid problem of the related art and an object of this invention is to provide a heat generation inhibiting circuit for a relay circuit which can reduce a heat generation amount of an exciting coil at the time of operating a relay circuit without increasing the minimum operation voltage of a relay contact which is closed normally.

Means for Solving the Problems

In order to attain the aforesaid object, the first invention relates to a heat generation inhibiting circuit, for inhibiting heat generation of an exciting coil, for a relay circuit (RLY) which includes a relay contact (Xa), that is provided between a DC power supply (VB) and a load (RL) and switches between driving and stop of the load, and the exciting coil (Xc) for energizing the relay contact, the heat generation inhibiting circuit including:

a first resistor (R1) which is provided between the exciting coil and ground;

a diode (D1) which anode is connected between the exciting coil and the first resistor and which cathode is connected between the relay contact and the load; and a switch unit which is provided between the DC power supply and the exciting coil and switches between energizing and non-energizing of the exciting coil.

The second invention relates to a heat generation inhibiting circuit, for inhibiting heat generation of an exciting coil, for a relay circuit (RLY) which includes a relay contact (Xa), that is provided between a DC power supply (VB) and a load (RL) and switches between driving and stop of the load, and the exciting coil (Xc) for energizing the relay contact, the heat generation inhibiting circuit including:

a first resistor (R1) which is provided between the exciting coil and ground;

a switch unit (SW1) which is provided between the DC power supply and the exciting coil and switches between energizing and non-energizing of the exciting coil;

a semiconductor element (T1) which is provided in parallel to the first resistor, first and second electrodes of the semiconductor element being connected to a first end and a second end of the first resistor, respectively; and a constant voltage diode (ZD1) which cathode is connected between the relay contact and the load and which anode is grounded via a second resistor (R4), wherein a control terminal of the semiconductor element is connected directly or indirectly between the anode of the constant voltage diode and the second resistor;

wherein until the relay contact is closed after the switch unit is turned on, the semiconductor element is made conductive between the first and second electrodes to apply a voltage almost same as an output voltage of the DC power supply to the exciting coil, and wherein after the relay contact is closed, a constant voltage depending on a constant voltage of the constant voltage diode is applied to the exciting coil.

The third invention further includes a diode (D1) which anode is connected between the exciting coil and the first resistor and which cathode is connected between the relay contact and the load.

The fourth invention relates to a heat generation inhibiting circuit, for inhibiting heat generation of an exciting coil, for a relay circuit (RLY) which includes a relay contact (Xa), that is provided between a DC power supply (VB) and a load (RL) and switches between driving and stop of the load, and the exciting coil (Xc) for energizing the relay contact, the heat generation inhibiting circuit including:

a first resistor (R1) which is provided between the exciting coil and ground; and a switch unit (SW2) which is provided between the first resistor and the ground and switches between energizing and non-energizing of the exciting coil, wherein a series connection circuit formed by a semiconductor element (T2) and a diode (D2) is connected between a point between the relay contact and the load and a point between the exciting coil and the first resistor, wherein until the relay contact is closed after the switch unit is turned on, the series connection circuit is made conductive to apply a voltage almost same as an output voltage of the DC power supply to the exciting coil, and wherein after the relay contact is closed, the series connection circuit is made nonconductive to apply a voltage lower than the output voltage of the DC power supply to the exciting coil.

The fifth invention relates to a heat generation inhibiting circuit, for inhibiting heat generation of an exciting coil, for a relay circuit (RLY) which includes a relay contact (Xa), that is provided between a DC power supply (VB) and a load (RL) and switches between driving and stop of the load, and the exciting coil (Xc) for energizing the relay contact, the heat generation inhibiting circuit including:

a first resistor (R1) which is provided between the exciting coil and ground; and a switch unit (SW2) which is provided between the first resistor and the ground and switches between energizing and non-energizing of the exciting coil, wherein a series connection circuit formed by a constant voltage diode (ZD2), a diode (D3) and a second resistor (R4) is connected between a point between the relay contact and the load and a point between the first resistor and the switch unit, wherein a semiconductor element (T1) is connected in parallel to the first resistor in a manner that first and second electrodes of the semiconductor element are connected to a first end and a second end of the first resistor, respectively, wherein until the relay contact is closed after the switch unit is turned on, the semiconductor element is made conductive between the first electrode and the second electrode to apply a voltage almost same as an output voltage of the DC power supply to the exciting coil, and wherein after the relay contact is closed a voltage depending on a constant voltage of the constant voltage diode is applied to the exciting coil.

According to the fifth invention, the DC power supply is a battery to be mounted on a vehicle.

Effects of the Invention

According to the first invention, since the exciting current flows on the ground side via the diode (D1) until the relay contact is closed immediately after the switch unit is turned on, the voltage applied to the exciting coil is almost same as the power supply voltage. Thus, the relay contact can be surely attracted to switch into the closed state. Further, when the relay contact is closed, since the exciting current flows on the ground side via the first resistor (R1), the voltage applied to the exciting coil reduces and hence the heat generation amount can be reduced. Accordingly, in the case of mounting on a PCB substrate etc., many relay circuits can be mounted on a narrow space, the reduction of a required space and the cost reduction can be realized. Further, since a leak current does not flow in the turned-off state of the switch unit, the power loss can be suppressed.

According to the second invention, since the exciting current flows on the ground side via the semiconductor element (T1) until the relay contact is closed immediately after the switch unit is turned on, the voltage applied to the exciting coil is almost same as the power supply voltage. Thus, the relay contact can be surely attracted to switch into the closed state. Further, when the relay contact is closed, due to the operation of the semiconductor element, the voltage applied to the exciting coil can be held to the constant voltage depending on the constant voltage of the constant voltage diode. Thus, the heat generation amount can be reduced by setting the voltage applied to the exciting coil to a voltage lower than the power supply voltage. Further, the exciting coil can be energized with a stable voltage without being influenced by the voltage change and the closed state of the relay contact can be surely held. Accordingly, in the case of mounting on a PCB substrate etc., many relay circuits can be mounted on a narrow space, the reduction of a required space and the cost reduction can be realized. Further, since a leak current does not flow in the turned-off state of the switch unit, the power loss can be suppressed.

According to the third invention, since the diode (D1) is further provided in addition to the configuration of the second invention, until the relay contact is closed immediately after the switch unit is turned on, since the current flows on the ground side via the diode (D1) in addition to the semiconductor element (T1), the voltage applied to the exciting coil can be made close to the power supply voltage.

According to the fourth invention, since the exciting current flows on the ground side via the semiconductor element (T2) and the diode (D2) until the relay contact is closed immediately after the switch unit is turned on, the voltage applied to the exciting coil is almost same as the power supply voltage. Thus, the relay contact can be surely attracted to switch into the closed state. Further, when the relay contact is closed, since the exciting current does not flow into the semiconductor element (T2) but flows on the ground side via the first resistor (R1), the voltage applied to the exciting coil reduces and hence the heat generation amount can be reduced. Accordingly, in the case of mounting on a PCB substrate etc., many relay circuits can be mounted on a narrow space, the reduction of a required space and the cost reduction can be realized. Further, since a leak current does not flow in the turned-off state of the switch unit, the power loss can be suppressed.

According to the fifth invention, since the exciting current flows on the ground side via the semiconductor element (T1) until the relay contact is closed immediately after the switch unit is turned on, the voltage applied to the exciting coil is almost same as the power supply voltage. Thus, the relay contact can be surely attracted to switch into the closed state. Further, when the relay contact is closed, due to the operation of the semiconductor element (T1), the voltage applied to the exciting coil can be held to the constant voltage depending on the constant voltage of the constant voltage diode. Thus, the heat generation amount can be reduced by setting the voltage applied to the exciting coil to a voltage lower than the power supply voltage. Further, the exciting coil can be energized with a stable voltage without being influenced by the voltage change and the closed state of the relay contact can be surely held. Accordingly, in the case of mounting on a PCB substrate etc., many relay circuits can be mounted on a narrow space, the reduction of a required space and the cost reduction can be realized. Further, since a leak current does not flow in the turned-off state of the switch unit, the power loss can be suppressed.

According to the sixth invention, since the battery mounted on a vehicle is used as the DC power supply, the exciting coil can be energized with a stable voltage even when a large voltage change occurs, whereby the relay circuit can be switched safely.

MODES FOR CARRYING OUT THE INVENTION

Hereinafter, an embodiment of this invention will be explained based on drawings. Usually, in a relay circuit having a normally-opened relay contact, a minimum operation voltage for turning the relay contact off (changing the contact to an opened state from a closed state) is lower than a minimum operation voltage for turning the relay contact on (changing the contact to the closed state from the opened state). That is, when the relay contact is once closed, the relay contact can maintain this state even when the voltage of the exciting coil reduces. This invention utilizes this phenomenon in a manner that almost the power supply voltage is applied to the both terminals of the exciting coil when a switch is turned on in the opened state of the relay contact to thereby secure the minimum operation voltage like the related art. Thereafter, when the relay contact is closed, a resistor is inserted into the current path of the exciting coil to limit the current flowing into the exciting coil to thereby inhibiting the heat generation. Detailed explanation will be made as follows.

FIRST EMBODIMENT

Figure 1:
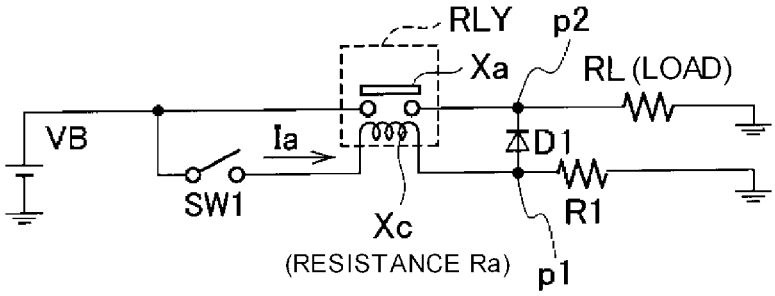
FIG. 1 is a circuit diagram showing the configuration of a load driving circuit on which a heat generation inhibiting circuit according to the first embodiment of this invention is mounted.

FIG. 1 is a circuit diagram showing the configuration of a load driving circuit on which a heat generation inhibiting circuit according to the first embodiment of this invention is mounted. As shown in FIG. 1, the load driving circuit includes a load RL such a lamp and a motor mounted on a vehicle, for example, and a DC power supply VB (for example, a battery, hereinafter abbreviated as "power supply VB"), and a relay circuit RLY is provided between the power supply VB and the load RL. The output voltage of the power supply VB is shown by the same symbol VB. This output voltage is 14 volt, for example.

The relay circuit RLY includes a normally-opened relay contact Xa and an exciting coil Xc. The one end of the relay contact Xa is connected to the positive electrode terminal of the power supply VB and the other end thereof is grounded via the load RL. The resistance value of the exciting coil Xc is Ra. The one end of the exciting coil Xc is connected to the positive electrode terminal of the power supply VB via a switch SW1 (switch unit) and the other end thereof is grounded via a resistor R1 (first resistor).

Further, a diode D1 is provided between a coupling point p1 between the exciting coil Xc and the resistor R1 and a coupling point p2 between the relay contact Xa and the load RL in a manner that the anode of the diode D1 is connected to the point p1 side and the cathode thereof is connected to the point p2 side.

Next, the action of the heat generation inhibiting circuit according to the first embodiment will be explained. When the relay circuit RLY is in a turned-off state, that is, when the switch SW1 is in a turned-off state, since current does not flow into the exciting coil Xc, the normally-opened relay contact Xa is opened. When the switch SW1 is turned on, since an exciting current Ia flows into the exciting coil Xc, the relay contact Xa is started to be attracted.

Figure 6:
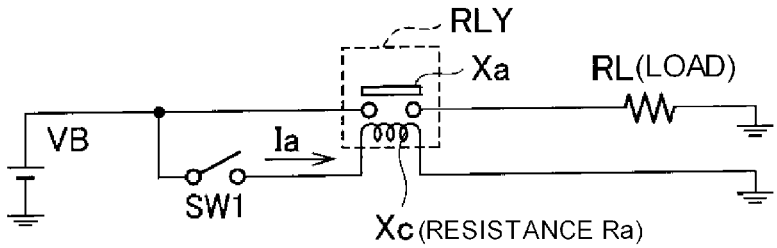
FIG. 6 is a circuit diagram showing the configuration of a load driving circuit of a related art and showing an example where a switch is provided on a power supply side.
Figure 7:
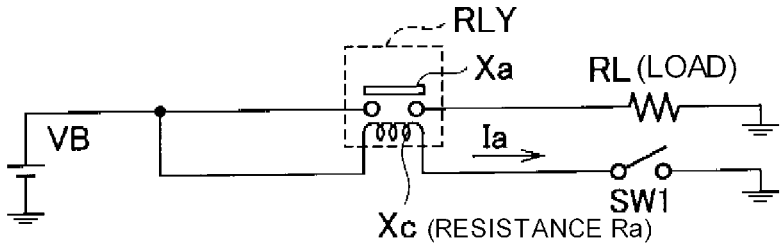
FIG. 7 is a circuit diagram showing the configuration of a load driving circuit of a related art and showing an example where a switch is provided on the ground side.
Figure 8:
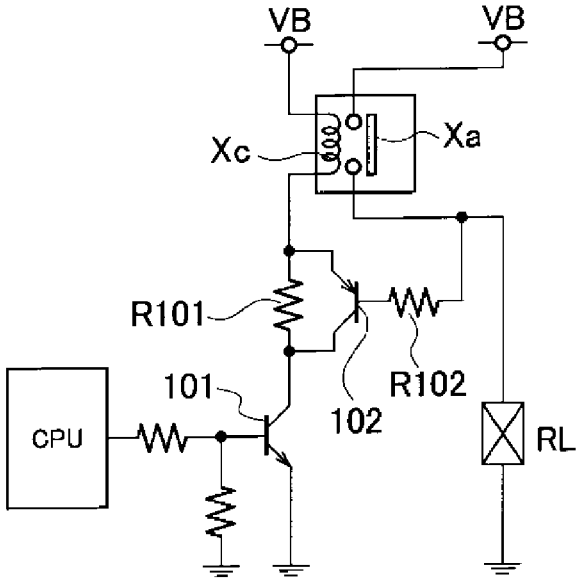
FIG. 8 is a circuit diagram showing the configuration of a load driving circuit shown in the patent document 1.

It takes 1 ms or more until the opened relay contact Xa is closed. During this period, the exciting current Ia flowing through the exciting coil Xc flows from the diode D1 to the ground via the load RL, whereby a voltage almost same as the power supply voltage VB is applied to the both ends of the exciting coil Xc. In other words, supposing that the voltage drop of the diode D1 is 0.6 volt, Ia will satisfy a relation of $Ia=(VB-0.6)/Ra$. Thus, the minimum operation voltage of the relay is almost same as that of the related art circuits (circuits shown in FIGS. 6 and 7).

Thereafter, when the relay contact Xa is closed, the load RL is applied with the power supply voltage VB. Thus, since the cathode voltage of the diode D1 becomes the power supply voltage VB, the diode D1 is reversely biased, whereby current having been flown through the diode D1 stops.

As a result, the exciting current Ia flows into the ground via the resistor R1 to thereby generate voltage drop across the resistor R1. That is, since Ia satisfies a relation of Ia=VB/(Ra+R1), the exciting current Ia reduces. For example, when Ra is set to be same as R1, the exciting current Ia reduces to a half. Thus, after the relay contact Xa is closed, the heat generation amount of the exciting coil Xc reduces as compared with that of the circuits of the related art. When the exciting current Ia reduces, the magnetic flux generated in the exciting coil Xc reduces and hence the attraction force of the relay contact Xa reduces. However, since the relay contact Xa is in the closed state, the magnetic resistance between the contact points of the relay contact Xa reduces, so that the closed state of the relay contact Xa can be maintained.

In this manner, according to the heat generation inhibiting circuit of the first embodiment, since the exciting current Ia flows on the load RL side via the diode D1 before the relay contact Xa is closed after the switch SW1 is turned on, the voltage almost same as the power supply voltage VB can be applied to the exciting coil Xc. Further, after the relay contact Xa is closed, the exciting current Ia does not flow through the diode D1 but flows through the resistor R1. Thus, the exciting coil Xc is applied with a voltage (half voltage in the case of Ra=R1) which is obtained by dividing the power supply voltage VB between the resistors Ra and R1.

Thus, the relay contact Xa in the opened state can be surely changed into the closed state. Further, when the relay contact Xa is closed, the relay contact can be surely held in the closed state thereafter. Furthermore, since the exciting current Ia reduces as compared with the related arts (Ia becomes a half in the case of Ra=R1) when the relay contact Xa is closed, the dissipation power amount of the power supply VB can be reduced and also the heat generation amount can be reduced.

Thus, in the case of mounting the relay circuit RLY on a PCB substrate, since many relay circuits can be provided within a constant space, the cost reduction and the reduction of a required space can be realized.

Further, since the circuit connected to the exciting coil Xc is surely interrupted at the time of turning the switch SW1 off, a leak current does not flow and hence the occurrence of a trouble such as the running out of the battery can be avoided.

SECOND EMBODIMENT

Next, the heat generation inhibiting circuit according to the second embodiment of this invention will be explained.

Figure 2:
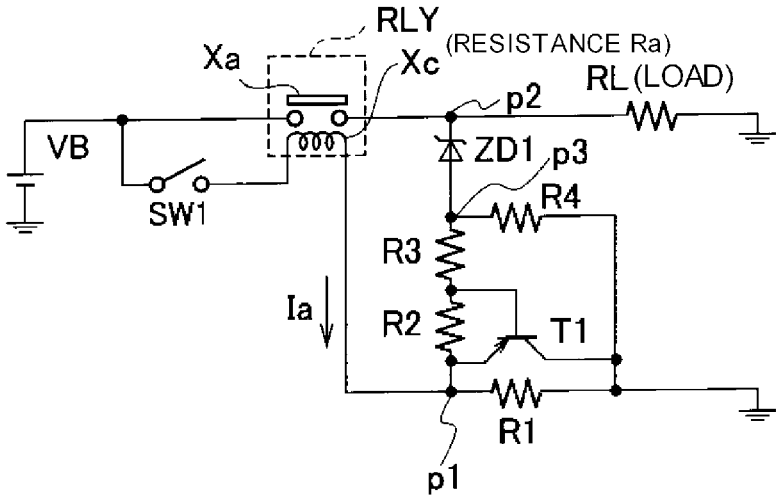
FIG. 2 is a circuit diagram showing the configuration of a load driving circuit on which the heat generation inhibiting circuit according to the second embodiment of this invention is mounted.

FIG. 2 is a circuit diagram showing the configuration of a load driving circuit on which the heat generation inhibiting circuit according to the second embodiment of this invention is mounted. The load driving circuit shown in FIG. 2 differs from the load driving circuit shown in FIG. 1 in a point that the diode D1 is not provided but resistors R2, R3, R4 (second resistor), a zener diode ZD1 (constant-voltage diode) and a PNP type transistor T1 (semiconductor element) are provided.

The cathode of the zener diode ZD1 is connected to the point p2 and the anode thereof is connected to the ground via the resistor R4 (second resistor). A connection point p3 between the zener diode ZD1 and the resistor R4 is connected to the point p1 via a bias circuit of the transistor T1 formed by the resistors R3 and R2, whilst a connection point between the resistors R3 and R2 is connected to the base of the transistor T1.

Further, the emitter of the transistor T1 is connected to the point p1 (first end of the resistor R1) and the collector thereof is connected to the ground (second end of the resistor R1). That is, the first electrode (emitter) of the semiconductor element (transistor T1) is connected to the first end of the first resistor and the second electrode (collector) thereof is connected to the second end of the first resistor.

Next, the action of the heat generation inhibiting circuit according to the second embodiment will be explained. When the relay circuit RLY is in the turned-off state, that is, when the switch SW1 is in the turned-off state, since current does not flow into the exciting coil Xc, the normally-opened relay contact is opened. When the switch SW1 is turned on, since the exciting current Ia flows into the exciting coil Xc, the relay contact Xa is started to be attracted.

During the opened state of the relay contact Xa, since the base of the transistor T1 is grounded via the resistor R3 and the resistor R4, the transistor T1 is turned on, whereby the exciting current Ia flowing through the exciting coil Xc flows between the emitter and the collector of the transistor T1. Thus, since the exciting coil Xc is applied with the voltage almost same as the power supply voltage VB (concretely, a voltage lower than the power supply voltage by a voltage almost equal to 1.8 volt generated at the transistor T1), the attraction force capable of closing the relay contact Xa can be maintained with a degree almost same as that of the related art circuits (circuits shown in FIGS. 6 and 7).

Thereafter, when the relay contact Xa is closed, the current flows from the power supply VB to the ground via the relay contact Xa, the zener diode ZD1 and the resistor R4 to thereby cause the voltage drop across the resistor R4. Thus, the base voltage of the transistor T1 increases and so the emitter voltage of the transistor T1 increases. As a result, the PNP-type transistor T1 operates as the emitter follower in which the resistor Ra of the exciting coil Xc acts as a resistor between the emitter and the power supply VB.

That is, when the relay contact Xa is closed, the transistor T1 continues to be made conductive as the emitter follower operation. In this case, the voltage generated across the both ends of the exciting coil Xc is a constant voltage determined by a constant voltage generated at the zener diode ZD1. To be concrete, since the voltage drop of the resistor R2 is about 0.6 volt (corresponding to the voltage drop of the diode) and the voltage drop of the resistor R3 is determined by the base current of the transistor T1, sum of the voltage drops of the resistors R2 and R3 is about 1.6 volt, for example. Supposing that the constant voltage of the zener diode ZD1 is 6 volt, the voltage applied across the both ends of the exciting coil Xc is 4.4 volt which is obtained by the subtraction therebetween, which is a constant voltage depending on the constant voltage of the zener diode ZD1. In other words, the voltage generated across the both ends of the exciting coil Xc can be set to an arbitrary value by determining the constant voltage of the zener diode ZD1.

Thus, in this heat generation inhibiting circuit, the voltage almost same as the power supply voltage VB is applied to the exciting coil Xc during a period until the relay contact Xa is closed after the switch SW1 is turned on. When the relay contact Xa is closed, the constant voltage depending on the constant voltage generated at the zener diode ZD1 is applied to the exciting coil Xc. In this case, since the voltage applied to the exciting coil Xc is not influenced by the change of the power supply voltage VB, the magnetic flux generated at the exciting coil Xc is constant.

In this manner, according to the heat generation inhibiting circuit of the second embodiment, since the exciting current Ia flows into the ground via the transistor T1 before the relay contact Xa is closed after the switch SW1 is turned on, the voltage almost same as the power supply voltage VB can be applied to the exciting coil Xc. Thereafter, when the relay contact Xa is closed, the transistor T1 operates as the emitter follower to thereby hold the voltage applied to the exciting coil Xc so as to be the constant voltage lower than the power supply voltage (voltage determined by the zener voltage).

Thus, the relay contact Xa in the opened state can be surely changed into the closed state. Further, when the relay contact Xa is closed, the closed state can be surely held thereafter. Furthermore, since the exciting current Ia reduces as compared with the related arts when the relay contact Xa is closed, the dissipation power amount of the power supply VB can be reduced and also the heat generation amount can be reduced. Thus, in the case of mounting the relay circuit RLY on a PCB substrate, since many relay circuits can be provided within a constant space, the cost reduction and the reduction of a required space can be realized.

Further, since the voltage applied to the exciting coil Xc is maintained to the constant voltage depending on the constant voltage of the zener diode ZD1, the exciting coil Xc can be energized with the constant voltage even in a case that the power supply voltage VB reduces frequently like a battery mounted on a vehicle. Thus, the reduction of the holding power of the relay contact Xa can be avoided.

Further, since the leak current does not flow in the turned-off state of the switch SW1, the occurrence of a trouble such as the running out of the battery can be avoided.

Modified Example of Second Embodiment

Figure 3:
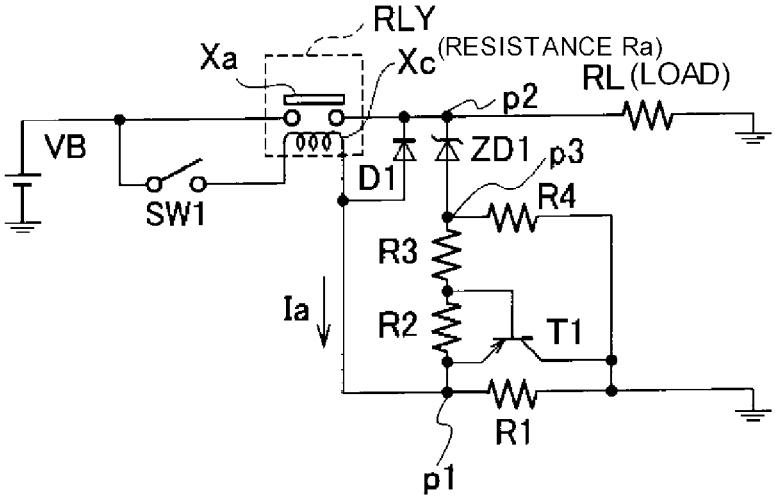
FIG. 3 is a circuit diagram showing the configuration of a load driving circuit on which the heat generation inhibiting circuit according to the modified example of the second embodiment of this invention is mounted.

Next, the heat generation inhibiting circuit according to the modified example of the second embodiment will be explained. FIG. 3 is a circuit diagram showing the configuration of a load driving circuit on which the heat generation inhibiting circuit according to the modified example is mounted. As shown in FIG. 3, this load driving circuit differs from the circuit shown in FIG. 2 in a point that the diode D1 is provided. That is, the diode D1 is provided in a manner that the anode thereof is connected to the connection point p1 between the exciting coil Xc and the resistor R1 and the cathode thereof is connected to the connection point p2 between the relay contact Xa and the load RL.

In the heat generation inhibiting circuit thus configured, during a period that the relay contact Xa is opened after the switch SW1 is turned on, since the exciting current Ia flowing into the exciting coil Xc flows from the diode D1 to the ground via the load RL, the voltage applied to the exciting coil Xc can be set closer to the power supply voltage VB as compared with the heat generation inhibiting circuit shown in FIG. 2. To be concrete, the voltage drop of the transistor T1 is about 1.8 volt as described above, whilst the voltage drop of the diode D1 is about 0.6 volt, so that the voltage applied to the exciting coil Xc can be increased by a value corresponding to the difference therebetween. Thus, the attracting force at the time of closing the relay contact Xa can be increased.

THIRD EMBODIMENT

Figure 4:
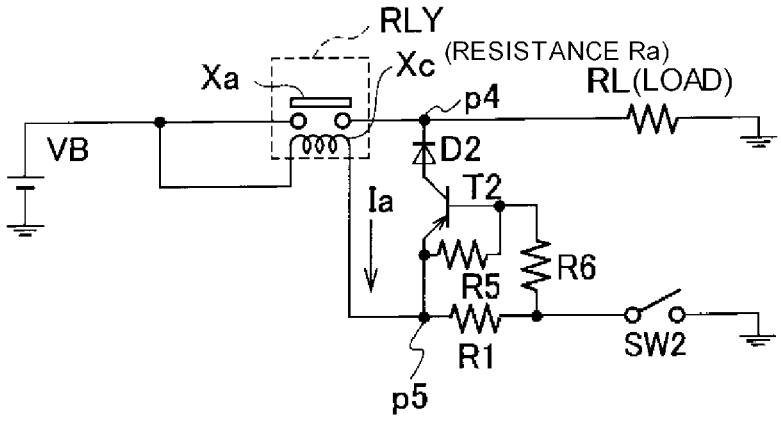
FIG. 4 is a circuit diagram showing the configuration of a load driving circuit on which the heat generation inhibiting circuit according to the third embodiment of this invention is mounted.

Next, the third embodiment of this invention will be explained. FIG. 4 is a circuit diagram showing the configuration of a load driving circuit on which the heat generation inhibiting circuit according to the third embodiment of this invention is mounted. As shown in FIG. 4, this load driving circuit includes the load RL such a lamp and a motor and the power supply VB (for example, a battery), and the relay circuit RLY is provided between the power supply VB and the load RL.

The relay circuit RLY includes the normally-opened relay contact Xa and the exciting coil Xc. The one end of the relay contact Xa is connected to the positive electrode terminal of the power supply VB and the other end thereof is grounded via the load RL. The one end of the exciting coil Xc is connected to the positive electrode terminal of the power supply VB and the other end thereof is grounded via the resistor R1 (first resistor) and a switch SW2 (switch unit). That is, the third embodiment differs from the first and second embodiments in a point that the switch SW2 is provided on the ground side of the exciting coil Xc.

A connection point t4 is connected via a diode D2 and a transistor T2 to a connection point t5 between the exciting coil Xc and the resistor R1. A resistor R5 is connected between the emitter and the base of the transistor T2. The base of this transistor is connected via a resistor R6 to a connection point between the resistor R1 and the switch SW2.

Next, the action of the heat generation inhibiting circuit according to the third embodiment will be explained. When the relay circuit RLY is in the turned-off state, that is, when the switch SW2 is in a turned-off state, since the transistor T2 is turned off, the exciting current Ia does not flow into the exciting coil Xc. Thus, the normally-opened relay contact Xa is opened.

When the switch SW2 is turned on, since the base of the transistor T2 is grounded, the transistor T2 is turned on. Thus, the exciting current Ia flows into the exciting coil Xc, so that the relay contact Xa is started being attracted. During a period where the relay contact Xa is opened, the exciting current Ia flows from the exciting coil Xc to the ground via the transistor T2, the diode D2 and the load RL but does not flow into the resistor R1. Therefore, since the exciting coil Xc is applied with a voltage almost same as the power supply voltage VB, the attraction force for closing the relay contact Xa is almost same as that of the related art circuits (circuits shown in FIGS. 6 and 7).

Thereafter, when the relay contact Xa is closed, since the diode D2 is reversely biased, current flowing into the transistor T2 is stopped, whereby the exciting current Ia flows from the resistor R1 to the ground via the switch S2. Accordingly, since the voltage drop arises across the resistor R1, the voltage applied to the exciting coil Xc becomes smaller than the power supply voltage VB by an amount corresponding to the voltage drop arises across the resistor R1, so that the exciting current Ia can be reduced. For example, supposing that R1 is equal to Ra, the voltage applied to the exciting coil Xc can be made half.

In this manner, according to the heat generation inhibiting circuit of the third embodiment, since the exciting current Ia flows on the load RL side via the transistor T2 and the diode D2 before the relay contact Xa is closed after the switch SW2 is turned on, the voltage almost same as the power supply voltage VB can be applied to the exciting coil Xc. Further, after the relay contact Xa is closed, the exciting current Ia does not flow through the diode D2 but flows through the resistor R1. Thus, the exciting coil Xc is applied with a voltage which is obtained by dividing the power supply voltage VB between the resistors Ra and R1.

Thus, the relay contact Xa in the opened state can be surely changed into the closed state. Further, when the relay contact Xa is closed, the relay contact can be surely held in the closed state thereafter. Furthermore, since the exciting current Ia reduces as compared with the related arts when the relay contact Xa is closed, the dissipation power amount of the power supply VB can be reduced and also the heat generation amount can be reduced.

Thus, in the case of mounting the relay circuit RLY on a PCB substrate, since many relay circuits can be provided within a constant space, the cost reduction and the reduction of a required space can be realized.

Further, since a leak current does not flow at the time of turning the switch SW2 off, the occurrence of a trouble such as the running out of the battery can be avoided.

FOURTH EMBODIMENT

Figure 5:
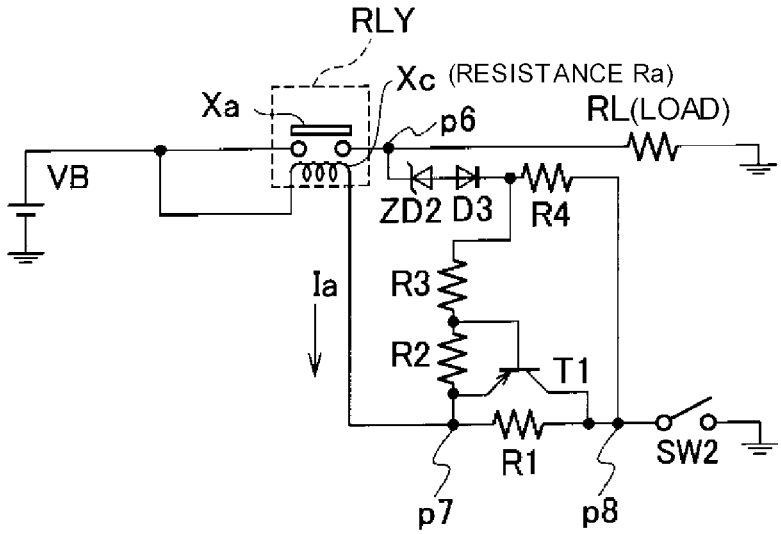
FIG. 5 is a circuit diagram showing the configuration of a load driving circuit on which the heat generation inhibiting circuit according to the fourth embodiment of this invention is mounted.

Next, the fourth embodiment of this invention will be explained. FIG. 5 is a circuit diagram showing the configuration of a load driving circuit on which the heat generation inhibiting circuit according to the fourth embodiment of this invention is mounted. As shown in FIG. 5, this load driving circuit includes the load RL such a lamp and a motor and the DC power supply VB, and the relay circuit RLY is provided between the power supply VB and the load RL.

The relay circuit RLY includes the normally-opened relay contact Xa and the exciting coil Xc. The one end of the relay contact Xa is connected to the positive electrode terminal of the power supply VB and the other end thereof is grounded via the load RL. The one end of the exciting coil Xc is connected to the positive electrode terminal of the power supply VB and the other end thereof is grounded via the resistor R1 (first resistor) and the switch SW2 (switch unit). That is, in the fourth embodiment, like the third embodiment, the switch SW2 is provided on the ground side of the exciting coil Xc.

A connection point between the relay contact Xa and the load RL is connected via a zener diode ZD2 (constant voltage diode), a diode D3 and the resistor R4 (second resistor) to a contact point p8 between the resistor R1 and the switch SW2. In this case, the cathode of the zener diode ZD2 is connected to the point t6, the anode thereof is connected to the cathode of the diode D3, and the cathode of the diode D3 is connected to the resistor R4.

Further, the PNP type transistor T1 is provided with respect to the resistor R1. The emitter of the transistor T1 is connected to a point t7 (first end of the resistor R1) and the collector thereof is connected to the point t8 (second end of the resistor R1). That is, the first electrode (emitter) of the semiconductor element (transistor T1) is connected to the first end of the first resistor and the second electrode (collector) thereof is connected to the second end of the first resistor Further, the point p7 is connected to a connection point between the diode D3 and the resistor R via a bias circuit for the transistor T1 formed by the resistors R2 and R3.

Next, the action of the heat generation inhibiting circuit according to the fourth embodiment will be explained. When the relay circuit RLY is in the turned-off state, that is, when the switch SW2 is in the turned-off state, since the exciting current Ia does not flow into the exciting coil Xc, the relay contact Xa is opened.

When the switch SW2 is turned on, since the base of the transistor T1 is grounded, the transistor T1 is turned on. Thus, the exciting current Ia flows into the exciting coil Xc, so that the relay contact Xa is started being attracted. During a period where the relay contact Xa is opened, since the base of the transistor T1 is grounded through a path from the resistor R3 to the ground via the resistor R4 and the switch SW2, the transistor T1 is turned on. In this case, the exciting current Ia flows through the transistor T1 but does not flow through the resistor R1. Therefore, since the exciting coil Xc is applied with a voltage almost same as the power supply voltage VB (strictly, voltage lower by about 1.8 volt), the attraction force for closing the relay contact Xa almost same as that of the related art circuits (circuits shown in FIGS. 6 and 7) can be maintained.

Thereafter, when the relay contact Xa is closed, the current flows from the power supply VB to the ground via the relay contact Xa, the zener diode ZD2, the diode D3, the resistor R4 and the switch SW2 to thereby cause the voltage drop across the resistor R4.

Thus, the base voltage of the transistor T1 increases and the emitter voltage of the transistor T1 increases. As a result, the transistor T1 operates as the emitter follower in which the resistor Ra of the exciting coil Xc acts as a resistor between the emitter and the power supply VB. The voltage generated across the exciting coil Xc at this time becomes a constant voltage depending on the constant voltage generated at the zener diode ZD2.

That is, in the heat generation inhibiting circuit according to the forth embodiment, until the relay contact Xa is closed after the switch SW2 is turned on, the exciting coil Xc is applied with the voltage almost same as the power supply voltage VB. Then, when the relay contact Xa is closed, the exciting coil Xc is applied with the constant voltage (voltage lower than the power supply voltage VB) depending on the constant voltage of the zener diode ZD2. Since the voltage applied to the exciting coil Xc does not depend on the power supply voltage VB, the magnetic flux generated at the exciting coil Xc becomes constant even when the power supply voltage VB reduces. Thus, the relay contact Xa can be attracted by a constant attraction force always.

In hits manner, according to the heat generation inhibiting circuit of the forth embodiment, since the exciting current Ia flows into the ground via the transistor T1 until the relay contact Xa is closed after the switch SW2 is turned on, the exciting coil Xc can be applied with the voltage almost same as the power supply voltage VB. Further, after the relay contact Xa is closed, the transistor T1 operates as the emitter follower to thereby hold the voltage applied to the exciting coil Xc so as to be the constant voltage lower than the power supply voltage VB (constant voltage determined by the zener voltage). Thus, the relay contact Xa in the opened state can be surely changed into the closed state and thereafter the closed state can be held surely.

Further, since the exciting current Ia reduces as compared with the related arts when the relay contact Xa is closed, the dissipation power amount of the power supply VB can be reduced and also the heat generation amount can be reduced. Thus, in the case of mounting the relay circuit RLY on a PCB substrate, since many relay circuits can be provided within a constant space, the cost reduction and the reduction of a required space can be realized.

Furthermore, the voltage applied to the exciting coil Xc is maintained to the constant voltage depending on the constant voltage of the zener diode ZD2. Thus, since the exciting coil Xc can be energized with the constant voltage even in a case that the power supply voltage VB reduces frequently like a battery mounted on a vehicle, the reduction of the holding power of the relay contact Xa can be avoided.

Further, since a leak current does not flow at the time of turning the switch SW2 off, the occurrence of a trouble such as the running out of the battery can be avoided.

Although the heat generation inhibiting circuit for an exciting coil in a relay is explained based on the embodiments shown in the drawings, this invention is not limited thereto, and each of the respective configurations may be replaced by an arbitrary configuration having the similar function.

For example, in each of the aforesaid embodiments, although the explanation is made as to the case where the PNP type bipolar transistor (semiconductor element) is used as each of the transistors T1, T2, this invention is not limited thereto and a P type MOSFET (semiconductor element) may be used therefor. Also, the circuit may be changed into a circuit having the similar function and an NPN type bipolar transistor or an N type MOSFET may be used.

This invention is quite useful for inhibiting the heat generation of the relay circuit including the normally-opened relay contact.

Although this invention is explained in detail with reference to the particular embodiments, it will be apparent for those skilled in the art to change or modify in various manners without departing from the spirit and range of this invention.

This application is based on Japanese Patent Application (Japanese Patent Application No. 2009-289678) filed on Dec. 21, 2009, the contents of which are incorporated herein by reference.

EXPLANATION OF SYMBOLS

RLY relay circuit
Xa relay contact
Xc exciting coil
D1, D2, D3 diode
ZD1, ZD2 zener diode (constant voltage diode)
R1 resistor (first resistor)
R4 resistor (second resistor)
VB DC power supply
RL load
SW1, SW2 switch (switch unit)
T1, T2 transistor (semiconductor element)

The invention claimed is:

1. A heat generation inhibiting circuit for an exciting coil in a relay, for inhibiting heat generation of the exciting coil in a relay circuit which includes a relay contact, that is provided between a DC power supply and a load and switches between driving and stop of the load, and the exciting coil for energizing the relay contact, the heat generation inhibiting circuit comprising:

a first resistor which is provided between the exciting coil and ground;

a diode which has an anode connected between the exciting coil and the first resistor and has a cathode connected between the relay contact and the load; and a switch unit which is provided between a positive electrode terminal of the DC power supply and the exciting coil and switches between energizing and non-energizing of the exciting coil.

2. The heat generation inhibiting circuit according to claim 1, wherein the DC power supply is a battery to be mounted on a vehicle.

3. The heat generation inhibiting circuit according to claim 1, wherein when the relay contact is closed, a current of the exciting coil flows into the ground through the first resistor.

4. A heat generation inhibiting circuit for an exciting coil in a relay, for inhibiting heat generation of the exciting coil in a relay circuit which includes a relay contact, that is provided between a DC power supply and a load and switches between driving and stop of the load, and an exciting coil for energizing the relay contact, the heat generation inhibiting circuit comprising:

a first resistor which is provided between the exciting coil and ground;

a switch unit which is provided between the DC power supply and the exciting coil and switches between energizing and non-energizing of the exciting coil;

a semiconductor element which is provided in parallel to the first resistor, and has a first electrode and a second electrode connected to a first end and a second end of the first resistor, respectively; and a constant voltage diode which has a cathode connected between the relay contact and the load and has an anode grounded via a second resistor, wherein a control terminal of the semiconductor element is connected directly or indirectly between the anode of the constant voltage diode and the second resistor;

wherein until the relay contact is closed after the switch unit is turned on, the semiconductor element is made conductive between the first electrode and the second electrode to apply a voltage almost the same as an output voltage of the DC power supply to the exciting coil; and wherein after the relay contact is closed, a constant voltage depending on a constant voltage of the constant voltage diode is applied to the exciting coil.

5. The heat generation inhibiting circuit according to claim 4, further comprising:

a diode which has an anode connected between the exciting coil and the first resistor and has a cathode is connected between the relay contact and the load.

6. The heat generation inhibiting circuit according to claim 4, wherein the DC power supply is a battery to be mounted on a vehicle.

7. A heat generation inhibiting circuit for an exciting coil in a relay, for inhibiting heat generation of the exciting coil in a relay circuit which includes a relay contact, that is provided between a DC power supply and a load and switches between driving and stop of the load, and the exciting coil for energizing the relay contact, the heat generation inhibiting circuit comprising:

a first resistor which is provided between the exciting coil and ground; and a switch unit which is provided between the first resistor and the ground and switches between energizing and non-energizing of the exciting coil;

wherein a series connection circuit formed by a semiconductor element and a diode is connected between a point between the relay contact and the load and a point between the exciting coil and the first resistor;

wherein until the relay contact is closed after the switch unit is turned on, the series connection circuit is made conductive to apply a voltage almost the same as an output voltage of the DC power supply to the exciting coil; and wherein after the relay contact is closed, the series connection circuit is made nonconductive to apply a voltage lower than the output voltage of the DC power supply to the exciting coil.

8. The heat generation inhibiting circuit according to claim 7, wherein the DC power supply is a battery to be mounted on a vehicle.

9. A heat generation inhibiting circuit for an exciting coil in a relay, for inhibiting heat generation of the exciting coil in a relay circuit which includes a relay contact, that is provided between a DC power supply and a load and switches between driving and stop of the load, and the exciting coil for energizing the relay contact, the heat generation inhibiting circuit comprising:

a first resistor which is provided between the exciting coil and ground; and a switch unit which is provided between the first resistor and the ground and switches between energizing and non-energizing of the exciting coil, wherein a series connection circuit formed by a constant voltage diode, a diode and a second resistor is connected between a point between the relay contact and the load and a point between the first resistor and the switch unit;

wherein a semiconductor element is connected in parallel to the first resistor and has a first electrode and a second electrodes connected to a first end and a second end of the first resistor, respectively;

wherein until the relay contact is closed after the switch unit is turned on, the semiconductor element is made conductive between the first electrode and the second electrode to apply a voltage almost the same as an output voltage of the DC power supply to the exciting coil; and wherein after the relay contact is closed, a voltage depending on a constant voltage of the constant voltage diode is applied to the exciting coil.

10. The heat generation inhibiting circuit according to claim 9, wherein the DC power supply is a battery to be mounted on a vehicle.

* * * * *